US007641750B2

(12) United States Patent
Turlan et al.

(10) Patent No.: US 7,641,750 B2
(45) Date of Patent: Jan. 5, 2010

(54) METHOD FOR FIXING SEVERAL LAYERS OF TEXTILE ALONG A LINE, PARTICULARLY ALONG THE EDGE OF A TEXTILE ITEM AND ITEM PRODUCED THUS

(75) Inventors: Manon Turlan, Marmagne (FR); Sandrine Rognard, Curgy (FR)

(73) Assignee: HBI Branded Apparel Enterprises, LLC., Winston-Salem, NC (US)

( * ) Notice: Subject to any disclaimer, the term of this patent is extended or adjusted under 35 U.S.C. 154(b) by 684 days.

(21) Appl. No.: 10/543,908

(22) PCT Filed: Jan. 29, 2004

(86) PCT No.: PCT/FR2004/000207

§ 371 (c)(1),
(2), (4) Date: Aug. 18, 2006

(87) PCT Pub. No.: WO2004/068983

PCT Pub. Date: Aug. 19, 2004

(65) Prior Publication Data

US 2007/0023125 A1 Feb. 1, 2007

(30) Foreign Application Priority Data

Feb. 3, 2003 (FR) ..... 03 01194

(51) Int. Cl.
*B32B 37/00* (2006.01)

(52) U.S. Cl. ..... 156/93; 156/155; 156/308.2; 156/309.6

(58) Field of Classification Search ..... 156/155, 156/93, 92, 308.2, 309.6
See application file for complete search history.

(56) References Cited

U.S. PATENT DOCUMENTS

| | | | | |
|---|---|---|---|---|
| 2,048,343 | A | 7/1936 | Liebowitz | |
| 3,137,864 | A * | 6/1964 | Ostmann, Jr. | 2/243.1 |
| 3,649,399 | A | 3/1972 | Nakanishi | |
| 3,690,277 | A * | 9/1972 | Baxter et al. | 112/475.24 |
| 4,604,152 | A * | 8/1986 | Liukko | 156/93 |
| 5,003,902 | A | 4/1991 | Benstock et al. | |
| 2004/0238103 | A1 * | 12/2004 | Cano | 156/155 |

FOREIGN PATENT DOCUMENTS

| | | | |
|---|---|---|---|
| EP | 1 033 084 | | 9/2000 |
| JP | 47-8788 | A * | 3/1972 |
| WO | WO 02/28210 | | 4/2002 |
| WO | WO-2005/093145 | A2 * | 10/2005 |

* cited by examiner

*Primary Examiner*—Jeff H Aftergut
(74) *Attorney, Agent, or Firm*—Ohlandt, Greeley, Ruggiero & Perle, LLP

(57) ABSTRACT

A process for fixing several textile thicknesses along a line, and particularly an edge of a textile article, of the type by which two stitched sewing threads are used, namely the lower and the upper is provided. One of the threads changes state at a first predetermined temperature. A glue for thermogluing the thicknesses is provided. The glue acts at a second predetermined temperature. The state changing thread melts at a first temperature that is lower than the second temperature. The other thread is eliminated after the state changing thread has melted. This results in a perfectly placed seamless assembly.

14 Claims, No Drawings

METHOD FOR FIXING SEVERAL LAYERS OF TEXTILE ALONG A LINE, PARTICULARLY ALONG THE EDGE OF A TEXTILE ITEM AND ITEM PRODUCED THUS

CROSS-REFERENCE TO RELATED APPLICATIONS

This application claims the priority of International patent application No PCT/FR2004/000207, filed on Jan. 29, 2004, which claims priority of French Patent Application No 0301194, filed on Feb. 3, 2003, the entire contents of both of which are incorporated by reference herein.

BACKGROUND OF THE INVENTION

1. Field of the Invention

This invention relates to a process for fixing several textile thicknesses along a line, and particularly an edge of a textile article, particularly but not exclusively underwear, and particularly an article such as underpants or bra with edges for which a tying is necessary.

2. Description of Related Art

It is known how to make a tying on the edge of openings of underwear articles, in other words to cover the edge by a textile ribbon folded in two overlapping the edge, this ribbon traditionally being sewn to fix it in place.

The objective nowadays is increasingly to avoid the use of sewn seams in underwear, both for the discomfort that sometimes results from sewing thread, and for aesthetic reasons.

It has already been proposed to fix several textile thicknesses along an edge by ultrasound using thermoplastic fibres (see WO 0228210) or thermogluing (see EP 1033084) or by processes using a combination of sewing and thermogluing (see U.S. Pat. No. 2,048,343). With the first two processes, there is a problem with precise positioning of the ribbon and the ribbon has the disadvantages of visible seams; an ordinary upper thread, for example made of cotton, is used for the seam with a thermoadhesive lower thread, for example made of cellulose acetate. The upper thread remains in place and is visible after the hotmelt operation.

BRIEF SUMMARY OF THE INVENTION

The purpose of the invention is to be able to assemble textile parts along a line and particularly an edge with no visible seams, particularly to make a seamless tying, but which is satisfactorily fixed to the edge of the article.

DETAILED DESCRIPTION OF THE INVENTION

The purpose of the invention is achieved by means of a process for fixing several thicknesses of textile along a line, and particularly an edge of an article, of the type by which two stitched sewing threads are used, namely the lower and the upper, in which one of the threads changes state at a first predetermined temperature, and in that means of thermogluing the said thicknesses are provided that act at a second predetermined temperature, characterised in that the state changing thread melts at a first temperature lower than the said second temperature and that the other thread is eliminated after the state changing thread has melted.

This operation consisting of removing the second thread is easy to do, even manually if necessary, since melting of the first thread as its temperature increases above the melting temperature to reach the thermogluing temperature, caused the disappearance of the tying-in between the first and the second thread. Therefore, the remaining thread, as in the case of simple tacking, is no longer bonded to the article and therefore can be removed simply by pulling it off manually.

Advantageously, the seam is made using a machine with a needle thread and a bobbin thread, the bobbin thread being made of a hotmelt material.

Advantageously, when the assembly line consists of an edge, the different thicknesses to be assembled consist of a thickness of the basic textile article and at least one thickness of a border ribbon. This may be a ribbon applied to only one side of the edge, or it may be two ribbons applied on each side. Preferably, the ribbon overlaps the edge of the main article to make a tying.

A textile according to this invention means any type of woven or non woven material made of natural or synthetic fibres, but also if applicable sheets of plastic that could be used in the textile industry to make all or some of the basic article, or to make all or some of the decorative edge or tying ribbon. In particular, the ribbon and the basic article may be made from the same textile material.

The process according to the invention is particularly useful when the basic article is made from a lightweight and fragile material, such as some materials used in underwear. In particular, the articles concerned may be underwired bras for which the tying was made on the brassiere cups (décolleté and under the arms) and the backs (top and bottom of the back), triangular bras, bikini pants, underpants and strings, for which the tying of the waist and thigh openings are made.

Thermogluing means according to the invention may be of any type but they advantageously consist of a film of thermogluing material placed between the thicknesses to be assembled. This film may be fixed by glue dabs. In a particularly advantageous manner, the film is perforated during manufacture, such that the thermoglued bond between the thicknesses is not continuous over the entire surface of the back glued textile thicknesses, but on the contrary forms a deformable network compatible with elastic elongations of the material and the ribbon.

We will now describe a particular embodiment of this type of tying.

The basic material of the article on which tying is done and the tying ribbon is advantageously made of an elastic locknit knitted fabric with composition 81% of microfibre polyamide and 19% elasthanne such as Lycra®, 190 g/m$^2$ and with extensions of 170% longitudinally and 110% in width at 30 N.

For example, the hotmelt glue may be a polyurethane glue deposited in the form of a perforated film with a thickness of about 50 μm and in which holes were perforated during extrusion to make an elastic and ventilated film. This film is deposited on the main material to be used as the strip ribbon, using dabs of polyurethane glue that cannot be reactivated. Therefore, this gives a strip made of a complex composed of the material—glue dab—glue film. This strip is cut into ribbons with a width equal to twice the width of the tying to be made on the article.

The ribbon is sewn overlapping the edge of the article using a zigzag lock stitch machine equipped with a tying guide. The hotmelt thread is located on the bobbin, while the non-melting thread is inserted in the needle. The hotmelt thread is a copolyamide thread with a count of 55 dtex that starts to melt at 90° C. The thread in the needle is a polyester resistant to temperatures of at least 180° C.

The assembly is thermoglued using a plate or cylinder thermogluing machine. During gluing, articles are held together by silicone-coated sheets to prevent the formation of folds. Thermogluing is made at a temperature of 180° C. and at a pressure of about 3 bars.

This temperature of 180° C. is greater than the melting temperature of the hotmelt thread, but is lower than the melting temperature of the thread installed in the needle and the tyings of the seam disappear.

The polyester holding thread is then removed.

The resulting tying is perfectly placed and appears seamless. It is also compatible with the necessary elasticity of the edges.

The invention claimed is:

1. A process for fixing a first textile and a second textile along a line, comprising:

placing a film of thermogluing material between the first and second textiles;

sewing of the first and second textiles and said film of thermogluing material together with a first thread and a second thread;

heating to a first predetermined temperature to melt said first thread;

heating to a second predetermined temperature to activate said film of thermogluing material; and removing said second thread.

2. The process according to claim 1, wherein said second thread is a needle thread and said first thread is a bobbin thread.

3. The process according to claim 2, wherein said bobbin thread comprises a hot melt material.

4. The process according to claim 1, wherein the first textile comprises a first ribbon.

5. The process according to claim 4, further comprising placing said first ribbon on the second textile so that said first ribbon overlaps the second textile.

6. The process according to claim 4, wherein the second textile comprises a second ribbon, and wherein said first and second ribbons comprise the same material.

7. The process according to claim 1, wherein said heating to a first predetermined temperature comprises melting said first thread so as to attach said film of thermogluing material to the first and second textiles.

8. The process according to claim 1, wherein said film of thermogluing material is perforated.

9. The process according to claim 2, wherein sewing further comprises forming a criss-cross pattern on a side of the first textile with said needle thread and said bobbin thread.

10. A process for fixing a first textile to a second textile, comprising:

placing a film of thermogluing material between of the first and second textiles;

securing the first and second textiles and said film of thermogluing material together with a needle thread and a bobbin thread;

heating to a first predetermined temperature to melt said bobbin thread so that a melted portion of said bobbin thread holds said film of thermogluing material and the first and second textiles in a predermined position with respect to one another; and heating to a second predetermined temperature to activate said film of thermogluing material so that the first textile is fixed to the second textile.

11. The process according to claim 10, further comprising removing said needle thread.

12. The process according to claim 10, wherein said bobbin thread comprises a hot melt material.

13. The process according to claim 10, wherein the first textile and/or the second textile comprise a ribbon material.

14. The process according to claim 10, wherein securing the first and second textiles and said film of thermogluing material together with said needle thread and said bobbin thread comprises sewing said needle thread and said bobbin thread so that a criss-cross pattern is formed on a side of the first textile.

* * * * *